US005131593A

United States Patent [19]

Siegfried et al.

[11] Patent Number: 5,131,593

[45] Date of Patent: Jul. 21, 1992

[54] SPLICING TECHNIQUE AND APPARATUS

[75] Inventors: Knecht Siegfried; Heinz Sonnenberg, both of Gevelsberg, Fed. Rep. of Germany

[73] Assignee: Maschinenbfabrik Alfred Schmermund GmbH & Co., Gevelsberg, Fed. Rep. of Germany

[21] Appl. No.: 578,740

[22] Filed: Sep. 6, 1990

[30] Foreign Application Priority Data

Sep. 8, 1989 [DE] Fed. Rep. of Germany ..... 3929981

[51] Int. Cl.[5] ..... B65H 19/18

[52] U.S. Cl. ..... 242/58.1

[58] Field of Search ..... 242/58.1, 58.3, 58.5; 156/189, 504, 505, 508, 509

[56] References Cited

U.S. PATENT DOCUMENTS

| | | | |
|---|---|---|---|
| 2,706,515 | 4/1955 | Evers | 242/58.1 |
| 2,978,199 | 4/1961 | McGraw, Jr. | 242/67.2 |
| 4,190,475 | 2/1980 | Marschke | 156/504 X |
| 4,196,866 | 4/1980 | Schaffner et al. | 242/58.1 X |
| 4,219,378 | 8/1980 | Marschke | 242/58.1 X |
| 4,264,401 | 4/1981 | Ganz | 156/505 X |
| 4,652,329 | 3/1987 | Focke | 156/505 X |
| 4,720,320 | 1/1988 | Niemi | 242/58.1 X |
| 4,859,270 | 8/1989 | Martin et al. | 242/58.1 X |

FOREIGN PATENT DOCUMENTS

| | | | |
|---|---|---|---|
| 1141848 | 12/1962 | Fed. Rep. of Germany . | |
| 1511791 | 7/1971 | Fed. Rep. of Germany . | |
| 2435192 | 2/1975 | Fed. Rep. of Germany | 242/58.1 |
| 2826715 | 12/1979 | Fed. Rep. of Germany | 242/58.1 |
| 2350580 | 7/1985 | Fed. Rep. of Germany . | |
| 1529678 | 10/1978 | United Kingdom | 242/58.1 |
| 2003119 | 3/1979 | United Kingdom | 242/58.1 |

*Primary Examiner*—Daniel P. Stodola
*Assistant Examiner*—John P. Darling
*Attorney, Agent, or Firm*—Chilton, Alix & Van Kirk

[57] ABSTRACT

The splicing of webs of packaging material delivered via a pair of individual feed zones into a common feed zone is accomplished through the use of a pair of cooperating change-over rollers located at the start of the common feed zone. A clamping device is provided for each web and the change-over rollers are provided with projections which cause the leading end of one web to be pinched against the other web to cause the two webs to be spliced together, the other web being subsequently severed at a point immediately upstream of the splice. The clamping devices, change-over rollers and severing devices may all be caused to operate automatically in the proper sequence.

19 Claims, 2 Drawing Sheets

SPLICING TECHNIQUE AND APPARATUS

BACKGROUND OF THE INVENTION (1) Field of the Invention

The present invention relates to the splicing of sheet material and particularly to the joinging of wrapping webs being delivered to cigarette-packaging machines. More specifically, this invention is directed to splicing apparatus having a pair of individual web feed zones which open into a common feed zone wherein a splicing mechanism which includes a pair of rollers is arranged, each roller being provided with means for severing one of the webs. Accordingly, the general objects of the present invention are to provide novel and improved methods and apparatus of such character.

(2) Description of the Prior Art

Packaging machines are often provided with supply reels for paper or foil which is utilized for wrapping the articles to be packaged. Webs of the wrapping material are drawn from the supply reels via draw rollers. Portions of the thus withdrawn webs are cut to the required length by means of a knife and then fed to a packaging station. Such packaging machines are, for example, employed in the cigarette industry wherein the so-called inner paper and the outer transparent film and, where soft packs are concerned, also the so-called outer paper, are fed to packaging stations.

Various techniques and devices have been proposed, and in some cases used, for effecting a change-over from one packaging material supply reel to another when the supply of material on the first reel becomes exhausted. Thus, by way of example, German Patent No. 2,350,580 shows apparatus wherein two wrapping-web guides open into a common feed zone. Each guide is equipped with a pair of draw rollers. A severing device is located in the common feed zone. A switching device serves for the alternate actuation of the pairs of draw rollers to thereby cause a change-over between supply reels. A cross-cutting device, switchable by the amount of one cutting step and associated with a stepping device, is provided for each guide. The change-over switching device is coupled to the stepping device in such a way that, during a change-over, the particular stepping device assigned to the pair of draw rollers previously in operation is actuated. The end of the wrapping web from the exhausted supply reel can thus be cut off before the common feed zone is reached, thereby preventing faults caused by a residual portion of the web from the exhausted supply reel being located in the common feed zone with the free end of the web from the other reel.

With devices of the type briefly described above, however, faults occur relatively frequently during reel changes when a free web end has to be threaded into the common feed zone. It is thus generally considered perferable to splice or otherwise connect the trailing end of the "old" web to the leading end of a "new" web. If such web splicing were to carried out manually, the packaging machine would have to be stopped frequently and for relatively long periods of time. Obviously, such shut-downs are incompatible with modern high-speed packaging technology.

As may be seen from published German Patent Application No. 1,141,848, "automatic" splicing devices are known. In the referenced publication, a clamping device is provided for each wrapping web. The clamping devices interact with a support which is provided in front of the entry into the nip of a pair of rollers. The clamping device operates by pressing a wrapping web into a grove by means of a clamping piece.

Reference may also be had to published German Patent Application No. 1,511,791 for a showing of the use, in a splicing device, of a separate knife for each wrapping web, elastic pressure pieces in the form of roller segments, the design of pressure pieces as welding devices, stops for the free end of the "new" web and cam-type actuating mechanisms.

SUMMARY OF THE INVENTION

The present invention overcomes the above-discussed and other deficiencies of the prior art and, in so doing, provides a method of and apparatus for splicing the leading and trailing edges of sheets or webs of flexible packaging material being drawn from supply reels wherein the splicing is accomplished automatically. Apparatus in accordance with the present invention employs, for each wrapping web, a web clamping device which interacts with a support provided in front of the entry into the nip of a pair of cooperating change-over rollers which define a common feed zone. The clamping devices may be opened either manually or via cam mechanisms which are coupled to the shafts of these rollers. The rollers are each provided with a cutting device and, in front of the cutting devices in the direction of rotation, each roller is further provided with a first resilient projection. Additionally, offset approximately 180° relative to the first resilient projection, each roller is provided with a second resilient projection. The first and second roller mounted resilient projections extend outwardly relative to the roller circumference and come into engagement with one another, under pressure, during roller rotation. The two rollers are relatively mounted so that a first and a second resilient projection respectively meet alternately.

Through the action of the pair of change-over rollers, the leading end of the packaging material on a full, i.e., unused, supply real is secured to the packaging material being drawn from an essentially empty reel, the web feeding from the virtually empty reel being severed at substantially the same time. The securing or splicing operation is performed in such a manner that the wrapping web always remains threaded in a common feed zone.

BRIEF DESCRIPTION OF THE DRAWINGS

The present invention may be better understood and its numerous objects and advantages will become apparent to those skilled in the art by reference to accompanying drawings wherein like reference numerals refer to like elements in the figures and in which.

DESCRIPTION OF THE DISCLOSED EMBODIMENT

Figure 1:
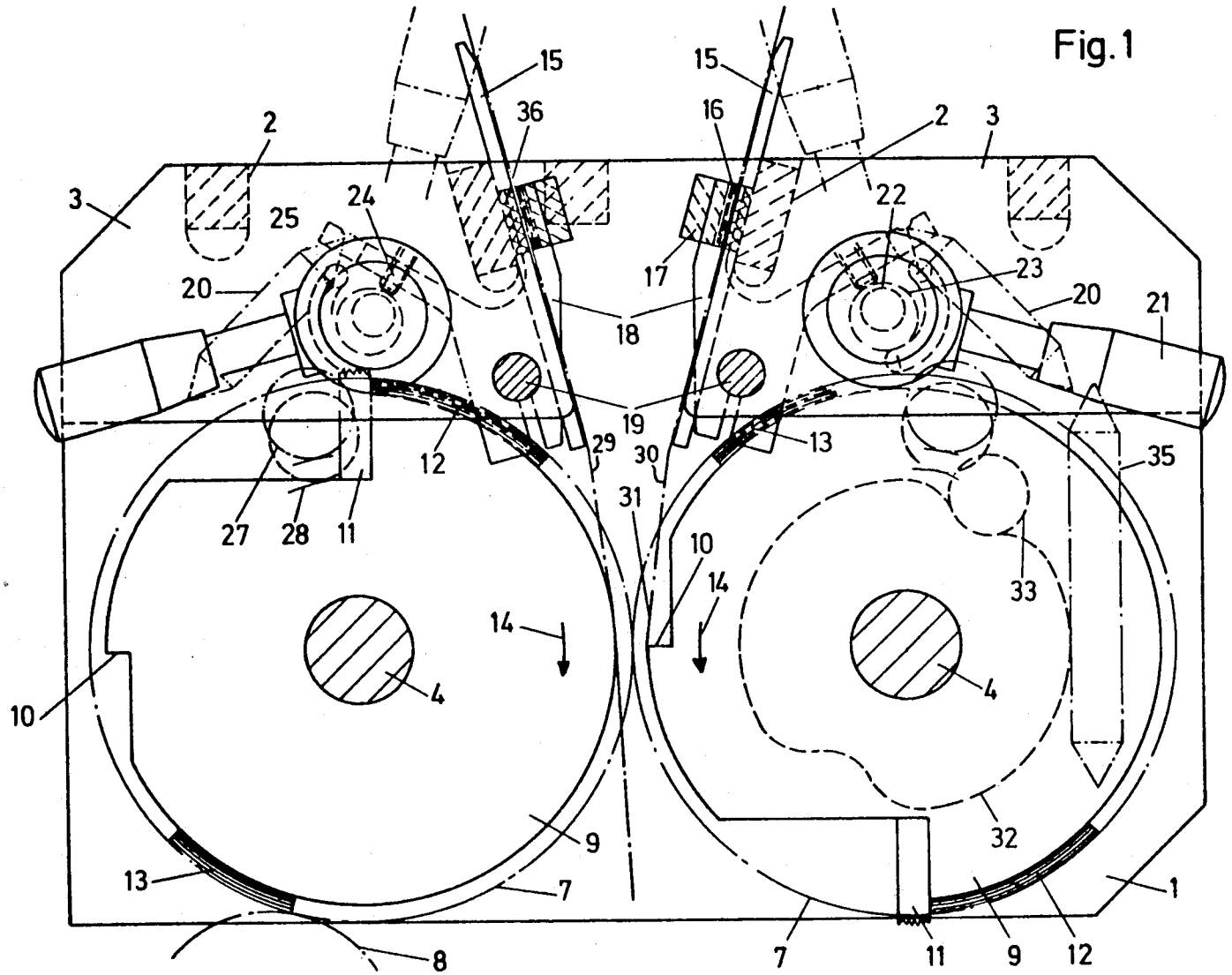
FIG. 1 is a schematic front elevational view of apparatus in accordance with the preferred embodiment of the present invention.
Figure 2:
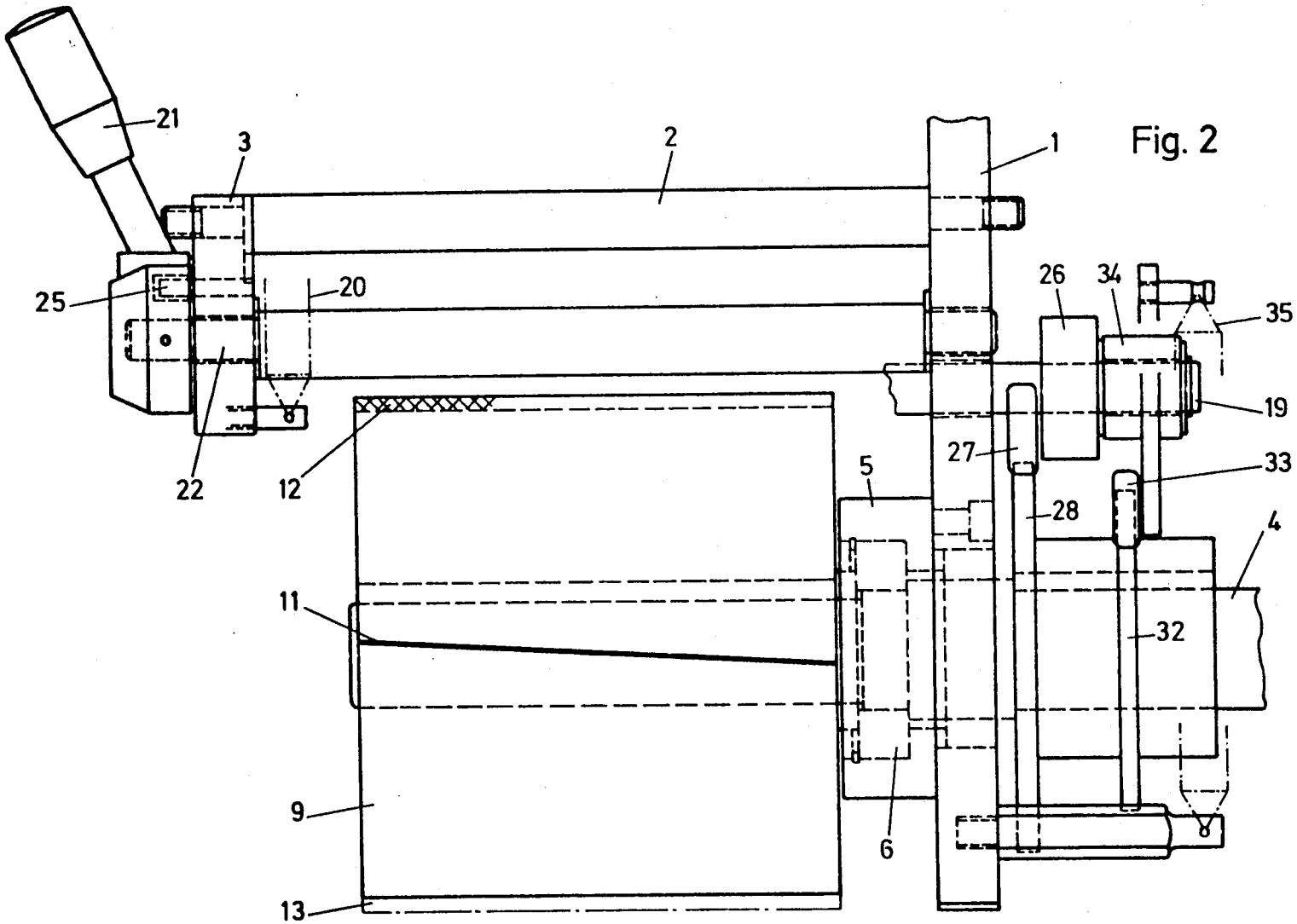
FIG. 2 is a view, partly cut away to reveal detail, of the apparatus of FIG. 1, FIG. 2 being taken from the right side of the apparatus as shown in FIG. 1.

With reference now to the drawings, a splicing apparatus in accordance with a preferred embodiment of the invention comprises a rear wall 1 and a pair of front-wall portions 3. The front wall portions 3 are connected to rear wall 1 via spacer bare 2. A pair of shafts of axles 4 are supported from rear wall 1 via respective bearing holders 5 which receive roller bearings 6. The shafts 4 each carry a gearwheel 7, the gearwheels meshing with one another. A first of gearwheels 7 engages, and thus is driven by, a pinion 8. Accordingly, shafts 4 will rotate simultaneously and in synchronism when pinion 8 is driven.

A change-over roller 9 is mounted on each of the shafts 4. The diameter of the rollers 9 selected so that there is a wide nip therebetween. Each roller 9 is equipped with a stop 10 in the form or an axially extending cutout. Each roller 9 carries a knife 11 which extends approximately obliquely relative to the generatrix of the roller. Each roller is also provided with a pair of resilient casing portions or projections 12, 13 which are, for example, comprised of rubber or the like. The casing portions 12, 13 are sufficiently thick to ensure that they come into engagement with one another under pressure, i.e., the resilient casing portions are in compression when in alignment, during rotation of the change-over rollers 9. Thus, the casing portion 12 of one change-over roller will contact the casing portion 13 of the other change-over roller during rotation, i.e., the rollers 9 are offset 180° relative to one another. The direction of rotation of the rollers 9 is indicated by arrows 14.

A support or guide 15, which is inclined relative to the nip of the change-over rollers, is mounted above and associated with each of rollers 9. The supports 15 are oriented so as to extend tangentially relative to the outer circumference of the roller diameters defined by the elastic casing portions 12,13. The supports 15 are located between the rear wall 1 and the front-wall portions 3. A clamping device which includes a clamping strip or member 17 interacts with each of the supports 15. The clamping members 17 are each provided with a friction-increasing pad 16 of elastic material. The clamping members 17 are each mounted on the first arm of an angle lever 18. The angle levers 18 are mounted on separate axles 19 and are rotatable about the axis of an axle 19. The axles 19 extend between the rear wall 1 and the front-wall portions 3. A helical spring 20, which is fastened to a front-wall portion 3, engages the free end of the second arm of each of the angle levers 18. The springs 20 thus bias the clamping members 17 into the closed clamping position against the associated support 15.

The clamping devices defined by the clamping members 17 and associated supports 15 can be caused to assume either the closed position shown or the open position manually or automatically. For manual operation, hand levers 21 are provided. The levers 21 are supported on shafts 22 which extend between rear wall 1 and respective front-wall portions 3. The hand levers 21 are connected to cams 23 which are rotatable about the shafts 22. The cams 23 cooperate with adjustable stops 24 mounted on the spring-biased second arms of the angle hand operated levers 18. The levers 21 are pivotable, through an angle of more than approximately 120°, from the approximately downwardly directed position in which they are shown in solid lines in FIG. 1 to the approximately obliquely directed, essentially vertical positions depicted in phantom in FIG. 1. The rotation of the hand operated levers 21 to the vertical position is limited by pins 25 supported from the front-wall portions 3. The hand operated levers 21, and thus the clamping devices, have two stable positions which are respectively commensurate with the open and closed positions of the clamps.

A crank member 26 is connected at a first end to each of the axles 19. The crank members 26 are connected at their second ends to associated cam followers 27 which roll on respective cams 28. The cams 28 are mounted on the shafts 4 and are provided with two circumferentially projecting regions which are located diametrically opposite to one another. Accordingly, via the camming action which is converted to rotation of an axle 19 by a crank member 26, the clamping devices may be caused to automatically assume either the open or closed state through imparting rotation to the shafts 4.

In the case of a cigarette packaging machine, for example, a pair of holders will be provided for wrapping-web supply reels for each of the inner-paper wrapping or the transparent outer film or the outer-paper wrapping. With a clamping device in the open state, a web or sheet of wrapping material 29 from a first supply reel (not shown) is guided by a support plate 15 through the nip between the change rollers 9 and then to a packaging station which may, for example, include a wrapping turret. The movement of the wrapping web 29 will typically be accomplished by cooperating rollers located at the packaging station which draw the web from the supply reel. In contrast, the wrapping web 30 from the other supply reel (not shown) is guided through the other clamp device over its guide plate 15 only up to the stop 10 of its associated change-over roller 9. This feeding-in of the wrapping web 30 may be accomplished with the clamp device moved to the open state by means of the hand lever 21 and will be done when the stop 10 is located in the region of the nip of the rollers 9. The free end of the web 30 will be provided with an adhesive tape 31. While the web 29 is being delivered to the packaging station, the clamping device through which it feeds will be in the open state and the clamping device for the web 30 will be in the closed state. Thus, during the operation of the packaging machine, the web 29 is drawn off of the supply reel and delivered through the wide, open nip of the rollers 9. When the supply reel for the web 29 is nearly empty, as indicated by an appropriate sensor, the speed at which the web 29 is being drawn off its supply reel will be reduced. When the appropriate web feed speed is reached, the web-splicing operation is initiated.

In order to initiate a splicing operation, the change-over rollers 9 are caused to begin rotation. The activation of the change-over rollers may, for example, be electronically controlled. At this time, the web 29 will still be feeding through the nip of rollers 9. As a result of rotation imparted to the cams 28, the clamping device for the web 30 will begin to open, thus enabling the downward feed of web 30 as the apparatus as shown in FIG. 1, while simultaneously causing the clamping device through which the web 29 has been feeding to begin to close. Continued rotation of the change-over rollers 9 will result in the webs 29 and 30 being forced together between the resilient casing portion 12 of one roller 9 and the cooperating resilient casing portion 13 of the other roller 9. The pinching action of rollers 9 will result in the webs 29 and 30 being adhesively secured to one another by means of the adhesive tape 31. Also, as rotation of the rollers 9 continues, the knife 11 on the roller associated with the nearly exhausted supply reel, in this case the reel which has been delivering the web 29, will come in contact with and thus sever the web. Accordingly, the trailing end of the web 29 located in the roller nip, and extending to the downstream packaging station, will be connected only to the leading end of the new web 30 which will now begin to feed. As rotation of the rollers 9 continues, the clamping device associated with the web 29 will be fully closed and the clamping device associated with the web 30 will be fully open and the speed of web delivery to the packaging station will be increased back to the maximum level. The empty supply reel, i.e., the reel which has supplied the web 29, can now be replaced and the "new" web once again threaded in as far as the stop 10 on the roller 9. The "new" web will, of course, be provided with an adhesive tape 31 so that the above-described operation may be repeated when the supply of packaging material on the reel from which the web 30 is being withdrawn becomes nearly exhausted.

In order to ensure that the rollers 9 and the clamping devices always assume their initial change-over position, further cams 32 are provided on the shafts 4. The cams 32 have a pair of recesses which are angularly offset by 180° relative to one another. Cam followers 33, fastened to the free ends of first arms of angle levers 34, engage the cams 32. The levers 34 are mounted on the shafts 19 and are biased by means of helical springs 35 which are anchored to the rear wall 1. After a splicing operation has been completed, and the next change-over position is reached, the rollers 9 are deactivated and fixed in the appropriate initial change position by the cam mechanism 32, 33, 34 and 35. As a result of the bias provided by the springs 35, the cam followers 33 are at this time retained in a respective recess of the cams 32. It is to be noted that the cam mechanism for ensuring that the components assume the initial change position need be provided on only one of the change-over rollers 9.

In order to improve clamping efficiency, the supports 15 can be provided with elastic friction-increasing strips 36 which face the pads 16 on the clamping members 17.

If the wrapping webs which are to be spliced are comprised of a material which can be welded, one of the cooperating change-over roller mounted elements 12 or 13 can be in the form of a heater, while the other is resilient, so that the two wrapping web ends to be spliced are brought into contact with one another between a non-elastic metallic heating element and an elastic element. If welding in the manner described is employed, the adhesive tape 31 is not required.

While a preferred embodiment has been shown and described, various modifications and substitutions may be made thereto without departing from the spirit and scope of the invention. Accordingly, it is to be understood that the present invention has been described in way of illustration and not limitation.

What is claimed is:

1. Apparatus for splicing two flexible webs of wrapping material comprising:

a pair of clamping means, said clamping means each comprising a clamping member and a cooperating support, said clamping means each in part defining an individual web feed zone which extends between the clamping member and its associated support, said individual web feed zones communicating with a common web feed zone located downstream in the direction of web travel from said individual feed zones;

a pair of cooperating change-over rollers rotatably supported on respective first axles at the upstream end of the common feed zone whereby a web of flexible wrapping material traveling through either one of said individual feed zones will pass between said change-over rollers;

lifting means for individually causing each of said clamping members to be lifted away from its cooperating support to permit web passage through an individual feed zone, said clamping members being operable in an out-of-phase relationship, said lifting means each including:

a pivotal lever connected at a first end top an associated clamp member; and means for resiliently biasing said pivotal lever toward the cooperating support of the clamping means, the lever being pivotal against the resilient bias to lift the clamping member away from the cooperating support;

knife means mounted on each of said change-over rollers for severing a web of flexible wrapping material passing therebetween;

a first resilient projection mounted on each of said change-over rollers in front of said knife in the direction of roller rotation; and a second projection mounted on each of said change-over rollers so as to be offset from the said first projection by 180°, said second projections being positioned such that the first projections on each of said change-over rollers come into engagement with the second projections on the other of said change-over rollers under pressure during change-over roller rotation, the trailing end of a first web of wrapping material being pressed against the leading end of a second web of wrapping material by cooperating first and second change-over roller projections during the splicing together of the web ends.

2. The apparatus of claim 1 wherein said lifting means further comprises:

a pair of hand operated levers, each of said hand operated levers being mounted on an associated second axle; and a cam mounted on each of said second axles for rotation in response to operation of the associated hand lever, each of said cams being coupled to an associated one of said pivotal levers to cause said pivotal levers to move against its resilient bias to lift a clamping member away from its cooperating support.

3. The apparatus of claim 2, wherein each change-over roller has an initial change-over position, said change-over positions being displaced by 180°, and wherein said apparatus further comprises:

means for causing said rollers to assume an orientation wherein one of said change-over rollers is in the initial change-over position after each splicing operation, said means for causing said rollers to assume said orientation including a resiliently biased cam means coupled to at least one of said first axles.

4. The apparatus of claim 1 wherein said lifting means further comprises:

a pair of cam mechanisms, each said cam mechanism including a first cam mounted on one of said first axles for rotation with the associated change-over roller, each said cam mechanism also including first cam follower means coupled to a said pivotal lever, said first cams being relatively oriented to cause said clamping means to be operated alternately and 180° out-of-phase.

5. The apparatus of claim 4 wherein said cam follower means each comprises a cam follower and a crank member, said crank members being connected between a cam follower and the associated pivotal lever.

6. The apparatus of claim 4 wherein said lifting means further comprises:

a pair of hand operated levers, each of said hand operated levers being mounted on an associated second axle; and a pair of second cams, said second cams being mounted on respective of said second axles for rotation in response to operation of the associated hand lever, each of said second cams being coupled to an associated one of said pivotal levers to cause said pivotal levers to move against its resilient bias to lift a clamping member away from its cooperating support.

7. The apparatus of claim 6 wherein said cam follower means of said cam mechanisms each comprise a first cam follower and a crank member, said crank members being connected between a said first cam follower and the associated pivotal lever.

8. The apparatus of claim 6 wherein each change-over roller has an initial change-over position, said change-over positions being displaced by 180°, and wherein said apparatus further comprises:

means for causing said rollers to assume an orientation wherein one of said change-over rollers is in the initial change-over position after each splicing operation, said means for causing said rollers to assume said orientation including a resiliently biased cam means coupled to at least one of said first axles.

9. The apparatus of claim 8 wherein said resiliently biased cam means comprises:

a third cam mounted on at least one of said first axles, said third cam having a pair of recesses which are offset by 180°, said recesses corresponding to said initial change-over positions; and spring biased second cam follower means, said second cam follower means applying a force to said third cam to thereby impart rotational motion to said third cam until said follower means is positioned in one of said recesses.

10. The apparatus of claim 4 wherein each change-over roller has an initial change-over position, said change-over positions being displaced by 180°, and wherein said apparatus further comprises:

means for causing said rollers to assume an orientation wherein one of said change-over rollers is in the initial change-over position after each splicing operating, said means for causing said rollers to assume said orientation including a resiliently biased cam means coupled to at least one of said first axles.

11. The apparatus of claim 1 further comprising a gear wheel mounted on each of said first axles, said gear wheels engaging one another, at least one of said gear wheels further being in engagement with a drive pinion.

12. The apparatus of claim 1 wherein each change-over roller has an initial change-over position, said change-over positions being displaced by 180°, and wherein said apparatus further comprises:

means for causing said rollers to assume an orientation wherein one of said change-over rollers is in the initial change-over position after each splicing operation, said means for causing said rollers to assume said orientation including a resiliently biased cam means coupled to at least one of said first axles.

13. The apparatus of claim 12 wherein said cam means comprises:

a cam mounted on at least one of said first axles, said cam having a pair of recesses which are offset by 180°, said recesses corresponding to said initial change-over positions; and spring biased cam follower means, said follower means applying a force to said cam to thereby impart rotational motion to said cam until said follower means is positioned in one of said recesses.

14. The apparatus of claim 1 wherein said second projections are at least in part comprised of a resilient material.

15. The apparatus of claim 1 wherein said second projections comprise heating elements for bonding together the webs of wrapping material.

16. The apparatus of claim 1 wherein each of said change-over rollers is provided with a stop which extends along a generatrix, said stops being sized and shaped for engagement by a respective web of wrapping material, said stops being located in the region of the nip of the cooperating change-over rollers in an initial web change position.

17. Apparatus for splicing two flexible webs of wrapping material comprising:

a pair of clamping means, said clamping means each comprising a clamping member and a cooperating support, said clamping means each in part defining an individual web feed zone which extends between the clamping member and its associated support, said individual web feed zones communicating with a common web feed zone located downstream in the direction of web travel from said individual feed zones;

a pair of cooperating change-over rollers rotatably supported on respective first axles at the upstream end of the common feed zone whereby a web of flexible wrapping material traveling through either one of said individual feed zones will pass between said change-over rollers, each of said change-over rollers having a stop which extends along a generatrix, said stops being sized and shaped for engagement by a respective web of wrapping material, said stops being locacted in the region of the nip of the cooperating change-over rollers in an initial web change position;

lifting means for individually causing each of said clamping members to be lifted away from its cooperating support to permit web passage through an individual feed zone, said clamping means being operable in an out-of-phase relationship;

knife means mounted on each of said change-over rollers for severing a web of flexible wrapping material passing therebetween;

a first resilient projection mounted on each of said change-over rollers in front of said knife in the direction of roller rotation; and a second projection mounted on each of said change-over rollers so as to be offset from the first projection by 180°, said second projections being positioned such that the first projections on each of said change-over rollers come into engagement with the second projections on the other of said change-over rollers under pressure during change-over roller rotation, the trailing end of a first web of wrapping material being pressed against the leading end of a second web of wrapping material by cooperating first and second change-over roller projections during the splicing together of the web ends.

18. Apparatus for splicing two flexible webs of wrapping material comprising:

a pair of clamping means, said clamping means each comprising a clamping member and a cooperating support, said clamping means each in part defining an individual web feed zone which extends between the clamping member and its associated support, said individual web feed zones communicating with a common web feed zone located downstream in the direction of web travel from said individual feed zones;

a resilient pad on each of said clamping members, said pads being on the side of the clamping member which faces the cooperating support;

a pair of cooperating change-over rollers rotatably supported on respective first axles at the upstream end of the common feed zone whereby a web of flexible wrapping material traveling through either one of said individual feed zones will pass between said change-over rollers;

lifting means for individually causing each of said clamping members to be lifted away from its cooperating support to permit web passage through an individual feed zone, said clamping means being operable in an out-of-phase relationship;

knife means mounted on each of said change-over rollers for severing a web of flexible wrapping material passing therebetween;

a first resilient projection mounted on each of said change-over rollers in front of said knife in the direction of roller rotation; and a second projection mounted on each of said change-over rollers so as to be offset from the said first projection by 180°, said second projections being positioned such that the first projections on each of said change-over rollers come into engagement with the second projections on the other of said change-over rollers under pressure during change-over roller rotation, the trailing end of a first web of wrapping material being pressed against the leasing end of a second web of wrapping material by cooperating first and second change-over roller projections during the splicing together of the web ends.

19. The apparatus of claim 18 wherein each of said clamping means supports is provided with a resilient strip which is in registration with a said pad.

* * * * *